US008281435B2

(12) United States Patent
Kent

(10) Patent No.: US 8,281,435 B2
(45) Date of Patent: Oct. 9, 2012

(54) REVERSIBLE HEAD-SUPPORT AND BOTTLE-SUPPORT BABY PILLOW

(76) Inventor: Charles Samuel Kent, Goodrich, TX (US)

( * ) Notice: Subject to any disclaimer, the term of this patent is extended or adjusted under 35 U.S.C. 154(b) by 63 days.

(21) Appl. No.: 12/832,912

(22) Filed: Jul. 8, 2010

(65) Prior Publication Data

US 2012/0005834 A1 Jan. 12, 2012

(51) Int. Cl.
*A47D 15/00* (2006.01)

(52) U.S. Cl. ..... 5/655; 5/639; 5/640; 248/102

(58) Field of Classification Search ..... 5/636, 637, 5/639, 640, 655, 632, 633; 248/102, 105, 248/106; D6/199
See application file for complete search history.

(56) References Cited

U.S. PATENT DOCUMENTS

| | | | | |
|---|---|---|---|---|
| 2,050,622 | A * | 8/1936 | Menk | 248/105 |
| 4,227,270 | A | 10/1980 | Rivera | |
| 4,345,347 | A | 8/1982 | Kantor | |
| 4,726,551 | A * | 2/1988 | Randall et al. | 248/102 |
| 4,809,938 | A | 3/1989 | Skinner et al. | |
| 4,895,327 | A * | 1/1990 | Malone et al. | 248/102 |
| D310,418 | S * | 9/1990 | Tribolet | D24/199 |
| 5,188,320 | A * | 2/1993 | Polka | 248/103 |
| 5,432,967 | A * | 7/1995 | Raftery | 5/633 |
| 5,765,225 | A | 6/1998 | Goeckeritz et al. | |
| 5,820,084 | A | 10/1998 | Trumbauer et al. | |
| 5,898,940 | A | 5/1999 | Cameron | |
| 6,000,664 | A | 12/1999 | Hood | |
| 6,098,934 | A | 8/2000 | Skelton | |
| D439,671 | S * | 3/2001 | Casillo et al. | D24/199 |
| 6,523,793 | B1 * | 2/2003 | Higgins | 248/102 |
| 6,536,058 | B1 * | 3/2003 | Chang | 5/636 |
| 6,745,399 | B1 | 6/2004 | Austin | |
| 6,931,683 | B1 * | 8/2005 | Elkin et al. | 5/655 |
| 7,213,791 | B2 | 5/2007 | Morris et al. | |
| 7,698,763 | B2 | 4/2010 | Warnock | |
| 2004/0140407 | A1 | 7/2004 | Morris et al. | |
| 2005/0029411 | A1 * | 2/2005 | Cannon | 248/105 |
| 2006/0102810 | A1 | 5/2006 | Banks | |
| 2007/0210219 | A1 | 9/2007 | Hiller | |
| 2008/0093513 | A1 | 4/2008 | Kunzelman | |
| 2009/0249526 | A1 | 10/2009 | Carangelo | |

OTHER PUBLICATIONS

Baby Bottle Cradle from http://www.babybottlecradle.com accessed on May 26, 2010.
Kids Head Support from www.boppy.com accessed on May 26, 2010.
Keep-It-Up Baby Bottle Holder from leachco.stores.yahoo.net/keepitup.html.

* cited by examiner

*Primary Examiner* — Michael Trettel
(74) *Attorney, Agent, or Firm* — Connie R. Masters

(57) ABSTRACT

A compact, pre-formed, reversible wedge-shaped pillow for supporting the head of a baby or, interchangeably, for supporting a bottle for a baby, is provided. The pillow includes a contoured, wedge-shaped body comprising a first longitudinal side, a second longitudinal side, a third longitudinal side, and two opposing angular ends. The first longitudinal side is configured with a head-receiving contour for isolating and supporting the baby's head during sleeping, feeding, or traveling in a car seat—thus reducing flat head syndrome. The third longitudinal side is configured with a bottle-receiving contour. If used in combination with a second pillow of the present invention, the head of the baby can rest within the head-receiving contour of the first pillow, while the bottle to feed the baby can rest within the bottle-receiving contour of the second pillow; thus assisting with proper digestion during feeding by elevating the head above the stomach level.

14 Claims, 6 Drawing Sheets

REVERSIBLE HEAD-SUPPORT AND BOTTLE-SUPPORT BABY PILLOW

FIELD OF THE INVENTION

The present invention relates generally to baby accessories, and more particularly, to a pillow interchangeably usable for supporting a baby bottle or supporting the head of an infant.

BACKGROUND INFORMATION

A head support for an infant can assist in preventing positional plagiocephaly or flat head syndrome, which may develop from mattress pressure against an infant's soft and malleable skull. The incidence of plagiocephaly has dramatically increased since 1992 when, to reduce the risk of SIDS (Sudden Infant Death Syndrome), parents were instructed to always place the infant in the supine (back) position to sleep. Doctors report now that between 10% and 30% of infants have some degree of plagiocephaly from spending extended periods of time lying on a hard surface (such as the crib mattress) in one position. Additionally, a recent study showed that infants that develop flat head syndrome may be more apt to experience delays in physical and mental development. Yet, the instructions for reducing SIDS also recommend that parents not use loose blankets or other loose bedding in the baby's bed to prop the head, as the risk of suffocation increases. So the head may tend to remain in one position, increasing the risk of flat head syndrome. A hard flat surface may also not be the most conducive to deep and restful sleep. The present invention addresses this problem by providing a baby head support pillow that encourages development of the natural head shape to reduce the occurrence of flat head syndrome without introducing loose bedding, while increasing comfortable sleep, and while allowing the baby to remain in the supine position to reduce the incidence of SIDS.

Additionally, due to physical developmental limitations in dexterity and muscle strength, an infant cannot support its own bottle to receive nutrition. Though parents find holding and feeding a baby enjoyable, at times it is necessary to support a bottle in a manner that allows the baby to drink from it. This is particularly an issue when twins or other multiples need to be fed simultaneously or when the parent is required to be otherwise occupied. For instance, the parent may be driving alone with the hungry baby in the car seat, thus requiring a support suitable for holding the bottle in a position allowing the baby to drink.

Further, caring for a baby requires a large number of items, such as accessories, clothing, and gear for feeding, bathing, diapering and traveling. The present invention addresses this problem by providing a compact item serving a dual purpose that is self-contained and easy to store.

Currently, no baby accessory is available having a bottle support and a baby head support that does not involve potentially dangerous loose bedding, yet reduces storage needs by serving a dual purpose. Some products provide side head support, for example, the Boppy® Head Support sold by leading retailers, the baby pillow of U.S. Patent Publication No. 2009/0249526 by Carangelo, and the support cushion of U.S. Pat. No. 4,345,347 by Kantor.

Other available products provide support for a bottle. Varied bottle holders are known in the art and address particular problems and situations.

Some have elastic straps that must be attached around the bottle, such as the bottle holder disclosed by Skinner et al. In U.S. Pat. No. 4,809,938, Skinner et al. claim a baby bottle holder comprising an envelope simulating the characteristics of an animated figure with an opening and a closure flap configured to allow stuffing to be placed in the envelope and comprising a pair of straps secured to the envelope that constitute the nose of the animated figure and that hold the bottle.

Some bottle support devices require the bottle to be suspended from, or tied to, an infant carrier or stroller, which may be time-consuming and difficult to position correctly, plus may introduce safety problems. Morris, in U.S. Pat. No. 7,213,791, claims a hanging means and a bottle holding means, configured so that the hanging means supports a bottle at the appropriate angle for feeding a baby positioned under the baby bottle holder (such as when in an infant seat). In U.S. Pat. No. 5,820,084, Trumbauer et al. claim a baby bottle support apparatus for attaching to an infant carrier comprising a wedge-shape support member, a cover member to enclose the support member, a high-friction gripping strip connected to the cover, an elastic member extending above the high-friction gripping strip, a bottle positioned between the elastic strip and the gripping surface, and a first and second strap for connecting to an infant carrier. Kunzelman, in U.S. Patent Publication No. 2008/0093513, discloses a filled body having a bottle fastener and support fasteners for attaching to an infant seat or stroller.

Some bottle holders are incorporated into a bib that must be worn by the baby, thus may be troublesome to use and to position. These include the bottle holders disclosed in U.S. Pat. No. 5,765,225 issued to Goecheritz et al. and U.S. Pat. No. 5,898,940 issued to Cameron. Another bottle holder, incorporated into a baby blanket and toy, is disclosed in the U.S. Published Application 2007/0210219 by Hiller. A different type of bottle holder is incorporated into a bib worn by the adult feeding the infant; this type is not usable in many situations, such as to feed a hungry baby in a car seat. In U.S. Pat. No. 6,000,664, Hood claims a yoke member for securing around the adult's neck, an adhering system to secure the bottle, including an elongated rectangular first attaching surface that receives a second complementary surface that is positioned around the bottle. Thus, one or more bottles surrounded by the second complementary surface may be positioned on the first attaching surface. Yet another type of bottle holder is formed of a foam block with a bottle-receiving channel, such as is disclosed in U.S. Patent Application Publication 2006/0102810 by Banks.

An additional type of bottle holder is a bottle holder combined with a baby pillow case for holding a baby pillow, shown in U.S. Pat. No. 4,227,270 by Rivera and in U.S. Pat. No. 6,745,399 by Austin. The case for the standard baby pillow in the Austin patent is located in a bib. The bottle holder in the Austin patent is a bag of strong material with an elastic containment band for securing around the bottle neck and with an exterior Velcro® attachment strip (for attaching to the center of the bib at the pillow storage pocket). The removable standard baby pillow is inserted into a pillow storage pocket in the bib, and then the pillow in the pocket may be used to elevate the bottle holder and encased bottle. The "soft structural material" used to form the bib, neck straps, and pocket and the "very soft structural fabric with sponge like fill material for supporting the baby's head" do not conform to the instructions given to parents to prevent SIDS. These instructions from the National Institute of Health state the following: "Keep soft objects and loose bedding away from sleep area." Thus the baby bottle holder, bib and standard baby pillow combination disclosed are only suitable for use during awake time when the parent is watching. Further, the center of the outward facing pillow pocket is configured with an exposed strip of complementary hook and loop fastener, so precludes resting a baby's head directly on the pillow storage compartment. The pillow pocket stores the pillow during travel, allowing access for removal when it is desired to place the standard baby pillow under the baby's head. Further, though Austin expounds on the virtue of providing both a bottle holder and a pillow for feeding, merely providing a storage compartment for a standard baby pillow (which is not recommended for use due to the risk of SIDS) does not meet the needs expressed. Therefore, Austin's disclosed bib with attachment means for the bottle holder and with storage means for the pillow is not suitable for use during sleeping and so cannot reduce the incidence of flat head syndrome.

Though many and varied bottle holders and pillows are suggested, none of these disclosed inventions endeavor to combine a supportive pillow for the head that also functions to support a bottle into a single device suitable for preventing flat head syndrome in a manner consistent with preventing SIDS.

SUMMARY OF THE INVENTION

The present invention is directed to a compact, pre-formed, reversible wedge-shaped pillow for supporting the head of a baby or, interchangeably, for supporting a bottle for a baby. The reversible head-support and bottle-support baby pillow includes a contoured, wedge-shaped body comprising a first longitudinal side, a second longitudinal side, a third longitudinal side, and two opposing lateral, angular ends.

The first longitudinal side is configured with a head-receiving contour for isolating and supporting the baby's head during sleeping, feeding or traveling in a car seat—thus reducing flat head syndrome. The third longitudinal side is configured with a bottle-receiving contour. If used in combination with a second pre-formed, wedge-shaped pillow, the head of the baby can rest within the head-receiving contour of the first pillow, while the bottle to feed the baby can rest within the bottle-receiving contour of the second pillow; thus assisting with proper digestion during feeding by elevating the head above the stomach level.

An object of the present invention is to provide a reversible head-support and bottle-support baby pillow that reduces the incidence of flat head syndrome by providing a contoured head support.

A further object of the present invention is to provide a reversible head-support and bottle-support baby pillow that is easy to use for supporting a baby's head or for supporting a baby's bottle by merely inverting the baby pillow.

Another object of the present invention is to provide a reversible head-support and bottle-support baby pillow that is compact and self-contained, without potentially dangerous loose structural members.

An additional object of the present invention is to provide a head-support and bottle-support baby pillow that positions a baby to promote good digestion during sleeping and napping.

Another object of the present invention is to provide a head-support and bottle-support baby pillow that can be effectively used with a second head-support and bottle-support baby pillow, by supporting the head with the first pillow and by supporting the bottle with the second pillow.

These and other objects, features and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward a compact, reversible head-support and bottle-support baby pillow that is suitable for holding the baby's head in an isolated and supportive manner without risk of suffocation due to soft loose bedding. Yet, even if the baby is consistently placed in a supine position to reduce the risk of SIDS, the head does not have pressure in one spot leading to flat head syndrome. Not only is the reversible head-support and bottle-support baby pillow supportive of the head and neck during sleeping, feeding, and/or traveling, the comfortable head position facilitates beneficial, positive, and effective sleep. The reversible head-support and bottle-support baby pillow provides comfort and reduces the incidence of flat head syndrome in healthy babies and may help to correct flat head syndrome in affected babies.

Upon inverting the baby pillow, the bottle-support is presented, furnishing a convenient means to hold a baby bottle in a position suitable for delivering nutrition to the baby, even though the baby cannot support the bottle on his own. Two baby pillows may be used simultaneously to perform both functions for the baby.

Figure 1:
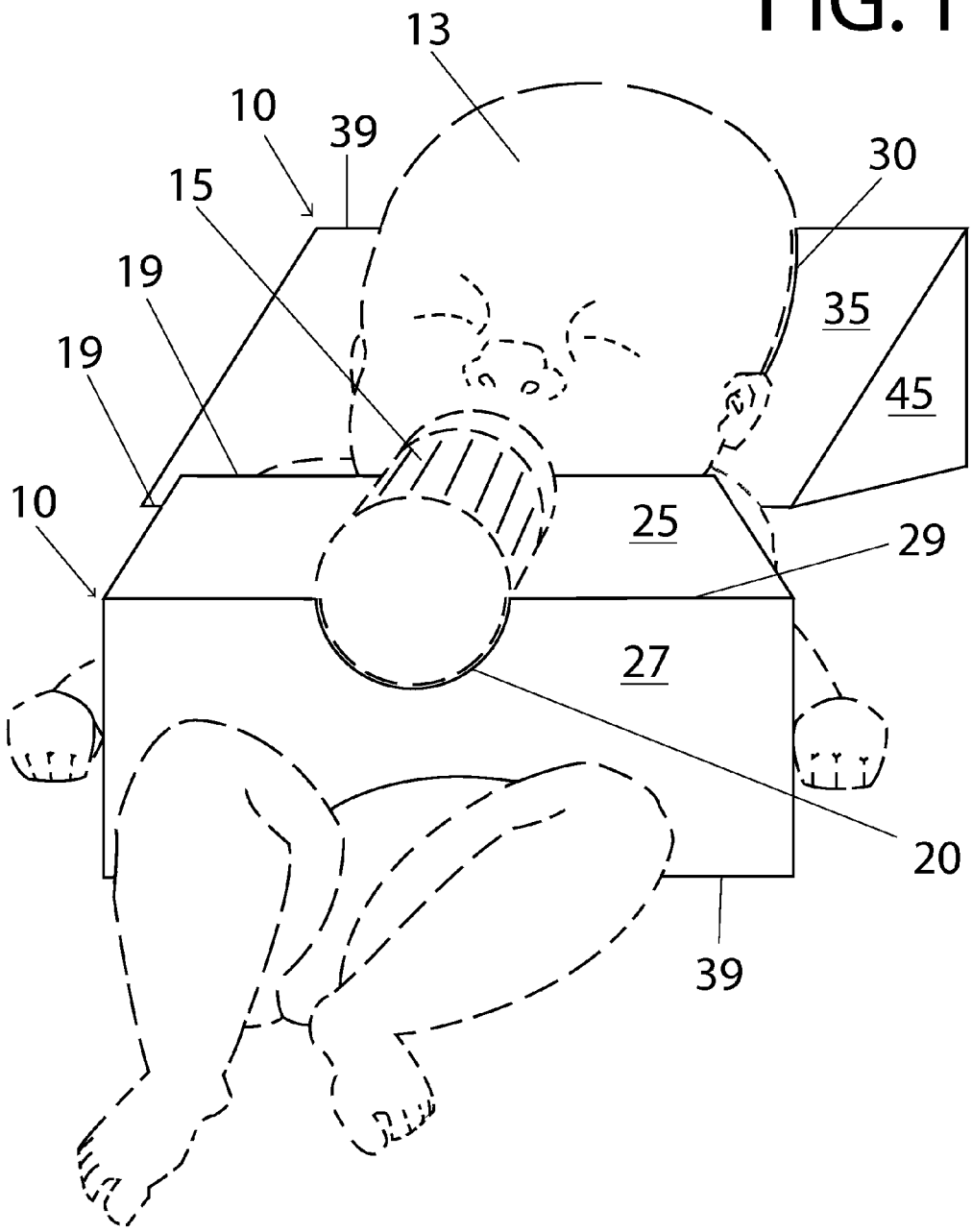
FIG. 1 is a perspective view showing an embodiment of the reversible head-support and bottle-support baby pillow of the present invention, with two baby pillows of the present invention; one pillow is being used for supporting the head and one for supporting the bottle to encourage proper digestion by keeping the head elevated above the stomach and supporting the bottle at an angle so the baby does not draw air.
Figure 2:
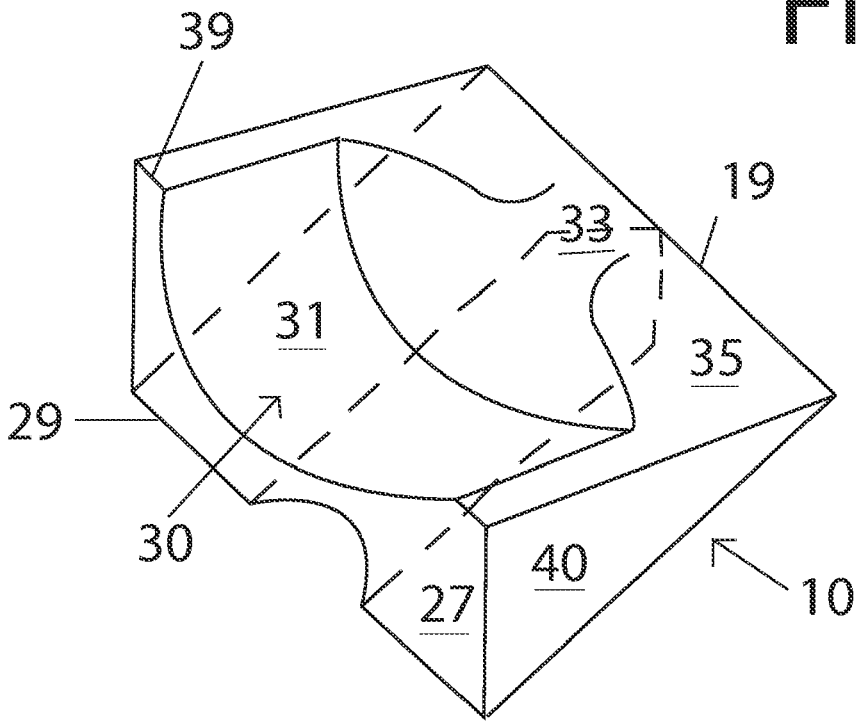
FIG. 2 is a perspective view showing a first preferred embodiment of the reversible head-support and bottle-support baby pillow of the present invention, with the head support contour upward, with dashed lines representing the underside of the baby pillow.
Figure 3:
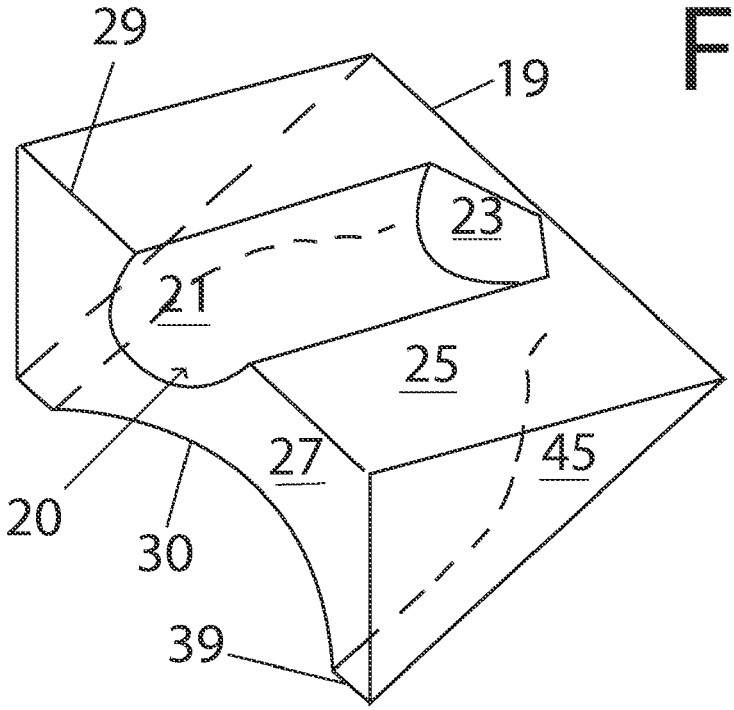
FIG. 3 is a perspective view showing a first preferred embodiment of the reversible head-support and bottle-support baby pillow of the present invention inverted so the bottle support contour is upward, with dashed lines representing the underside of the baby pillow.
Figure 4:
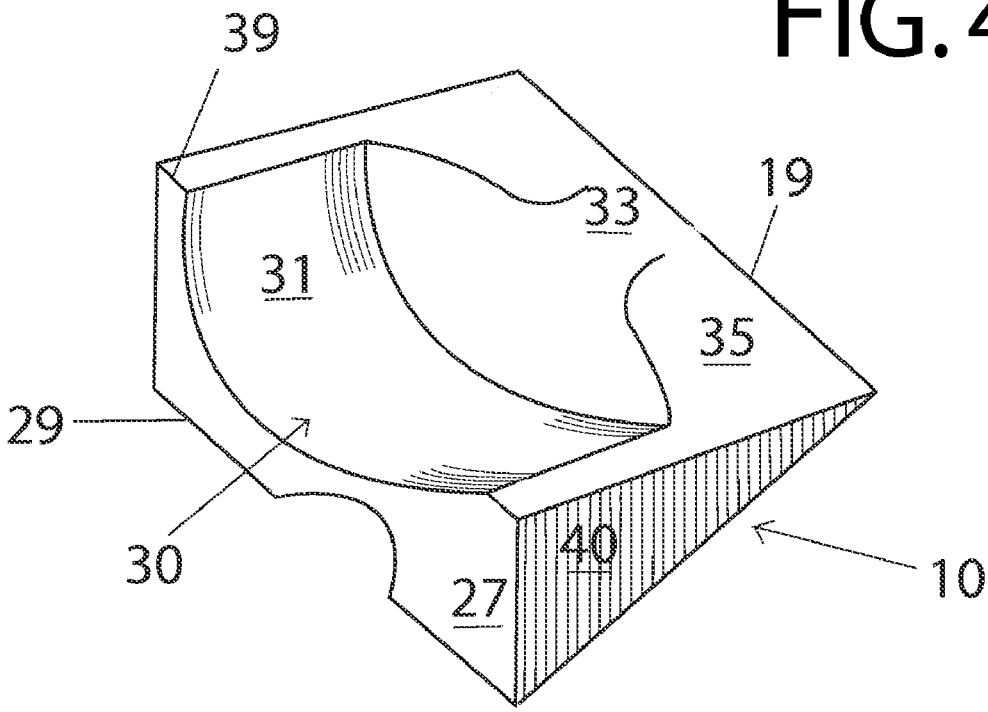
FIG. 4 is a perspective view showing a first preferred embodiment of the reversible head-support and bottle-support baby pillow of the present invention, with the head support contour upward.
Figure 5:
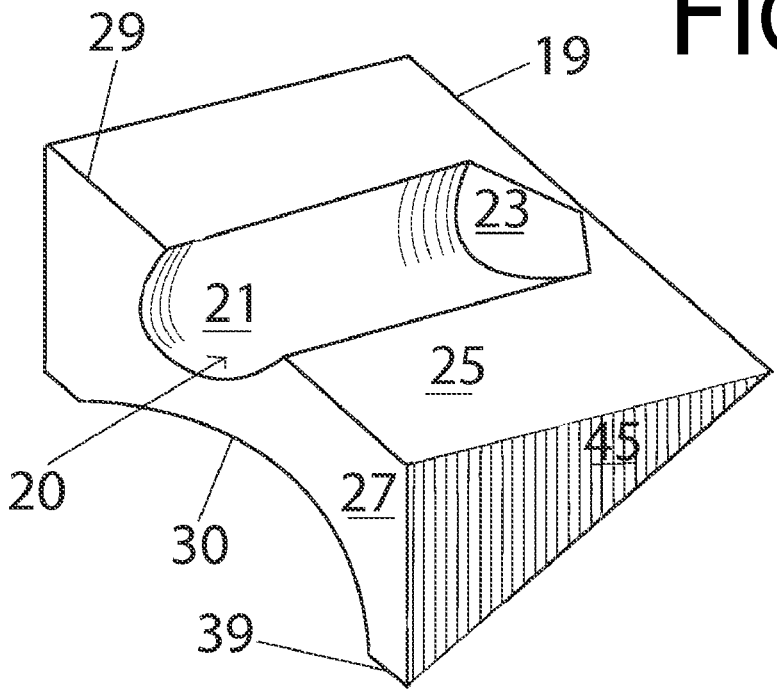
FIG. 5 is a perspective view showing a first preferred embodiment of the reversible head-support and bottle-support baby pillow of the present invention inverted so the bottle support contour is upward.

Referring now to FIG. 1, two reversible head-support and bottle-support baby pillows, each generally shown as reference number 10, are illustrated in accordance with a first embodiment of the present invention; one is being utilized for supporting the baby's head 13 and the other is being utilized for holding the baby's bottle 15. This position is advantageous, encouraging proper digestion by maintaining the head elevated above the stomach during feeding, reducing trapped air and discomfort, and allowing the baby to freely receive the nutrition from the bottle 15.

Turning to FIG. 2 to FIG. 5, the reversible head-support and bottle-support baby pillow 10 is shown without the baby 13. The baby pillow 10 has a wedge-shaped body formed by three joined longitudinal sides 25, 27, 35 with two opposing, planar, angular ends 40, 45 closing the ends of the wedge. The baby pillow 10 of the first three embodiments is generally a triangular prism (with removed contoured areas) formed by the two triangle shaped angular ends 40, 45 and the three rectangular longitudinal sides 25, 27, 35 (with the edges 19, 29, 39 between the longitudinal sides 25, 27, 35).

The first longitudinal side 35 is configured with a head-receiving contour 30 adapted to receive and to support the neck and head 13 (FIG. 1). The head-receiving contour 30 includes a neck support contour 33 configured to receive the neck of said baby smoothly transitioned into a wider head rest contour 31 configured to receive the head of said baby, as illustrated. The head rest contour 31 conforms to the natural, rounded shape of the head 13; it is generally a wide arc-shaped depression. The large amount of surface area of the head-receiving contour 30 that is in contact with the head and the neck of the baby minimizes pressure and reduces pressure points compared to commercially available baby head supports that provide only side head support.

Figure 6:
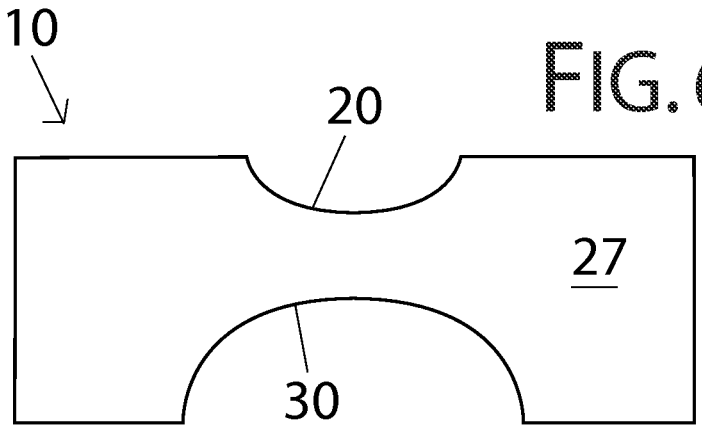
FIG. 6 is an end view showing a second embodiment of the reversible head-support and bottle-support baby pillow of the present invention.
Figure 7:
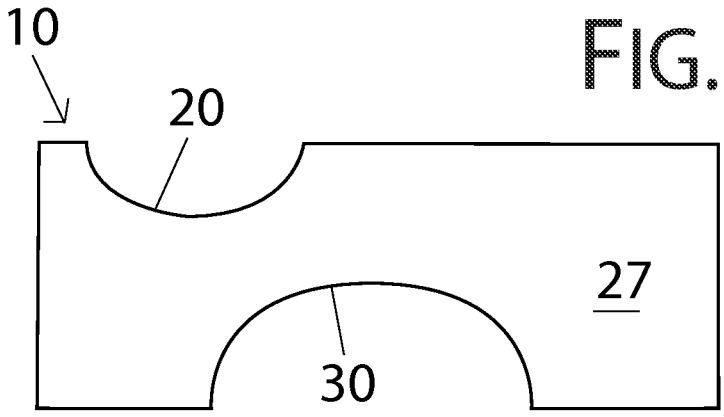
FIG. 7 is an end view showing a first embodiment of the reversible head-support and bottle-support baby pillow of the present invention.
Figure 8:
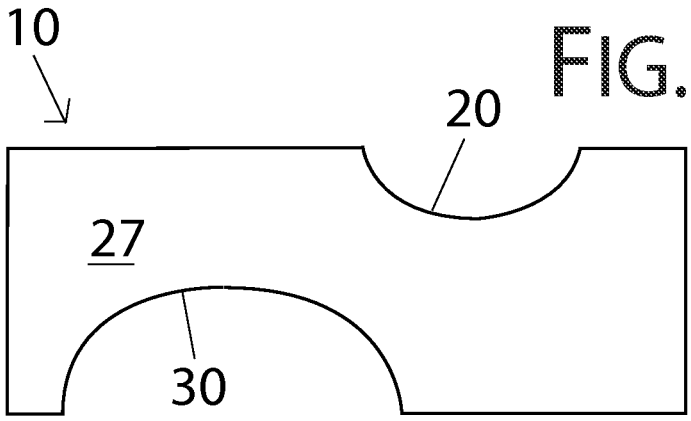
FIG. 8 is an end view showing a third embodiment of the reversible head-support and bottle-support baby pillow of the present invention.

The open end of the arc-shaped depression of the head rest contour 31 appears as a cutout arc when viewed from the second longitudinal side 25, as seen in FIG. 6 to FIG. 8. The neck support contour 33 is generally a narrower arc-shaped depression sized and adapted for the baby's neck. Thus, the smooth, pre-formed shapes of the head-receiving contour 30 comfortably embrace the back of the neck and the back of the head 13, providing support while reducing pressure points.

The neck support contour 33 and the head rest contour 31 are configured to allow the baby to rest in a comfortable, relaxing, pressure-free position. Thus the reversible head-support and bottle-support baby pillow 10 of the present invention provides a stress-free, positive, and effective sleep position, encouraging deep and restful sleep. It also provides comfortable feeding and traveling positions.

When the pillow 10 is inverted, the bottle-receiving contour 20 will be positioned upward with the head-receiving contour 30 positioned downward over the baby's body. The sides of the first longitudinal side 35 (the portion of the first longitudinal side 35 exterior to the head rest contour 31) may or may not rest directly on the baby, depending both on the positioning of the baby pillow 10 by the parent and on the movement of the baby. In some cases the head rest contour 31 may straddle the baby's body.

The third longitudinal side 25 meets the first longitudinal side 35 at an acute angle at edge 19. The third longitudinal side 25 is configured with a bottle-receiving contour 20. Bottle-receiving contour 20 is sized and adapted for receiving and supporting a conventional baby bottle. The bottle-receiving contour 20 includes both a bottle rest contour 21 and a bottle stop contour 23. The bottle rest contour 21 is a generally bottle-shaped channel ending in bottle stop contour 23. The bottle rest contour 21 is a depression having a shape corresponding to a lower portion of a cylindrical bottle; thus a cross-section of bottle rest contour 21 is an arc. The open end of bottle rest contour 21 generally forms a cutout arc within second longitudinal side 25, as seen in FIG. 6 to FIG. 8. The bottle stop contour 23 is an angled impediment to prevent the bottle 15 (FIG. 1) from being drawn too far forward as the baby sucks. Bottle stop contour 23 may be a depression having a shape corresponding to a portion of a cone or may be an angled portion. The specific widths and angles used in the bottle-receiving contour 20 may vary while still allowing the bottle 15 to be retained by gravity due to the shape and tilt of the bottle-receiving contour 20.

Figure 9:
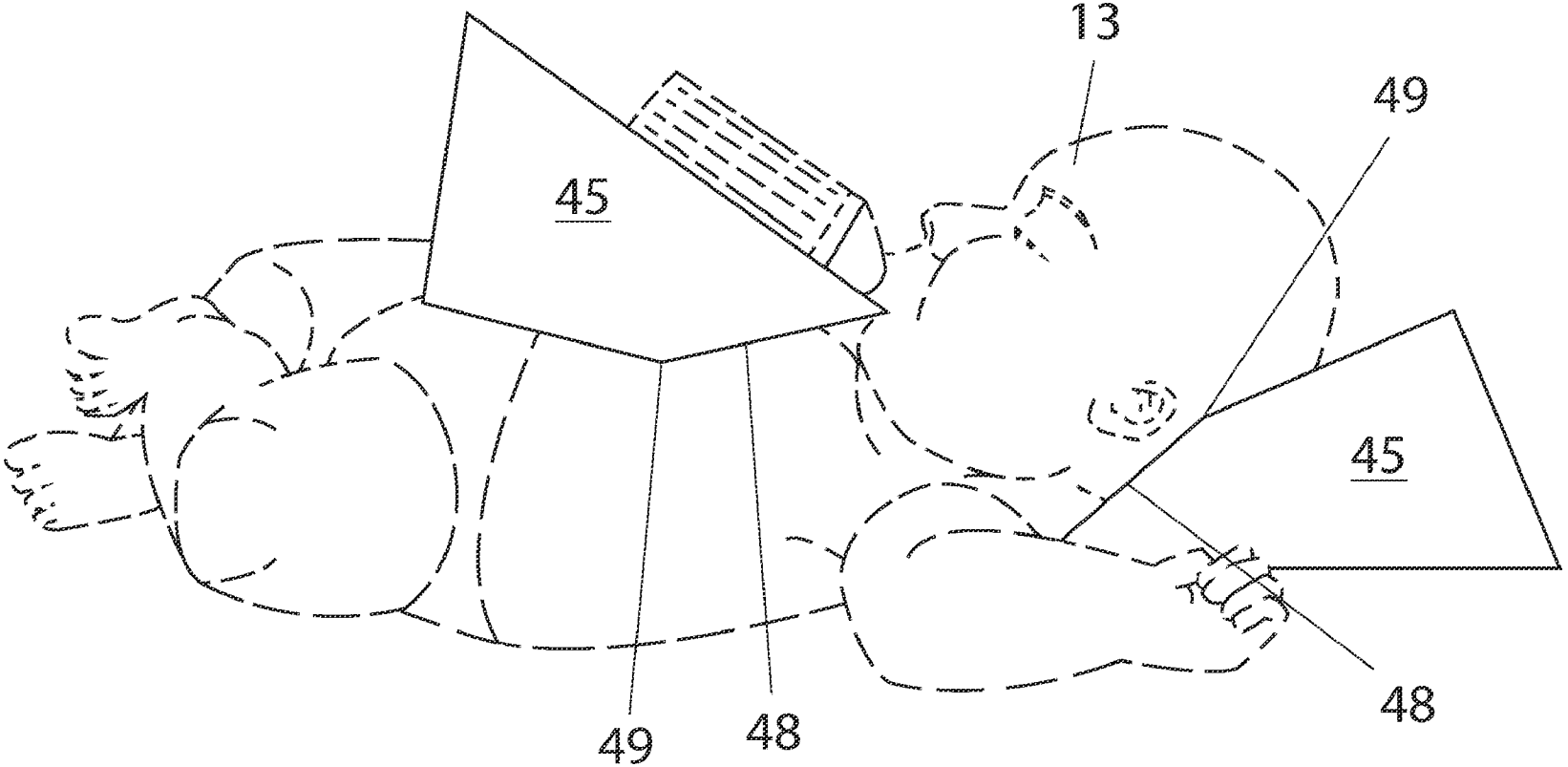
FIG. 9 is a side view showing a fourth embodiment of the reversible head-support and bottle-support baby pillow of the present invention with the baby in a lying position.
Figure 10:
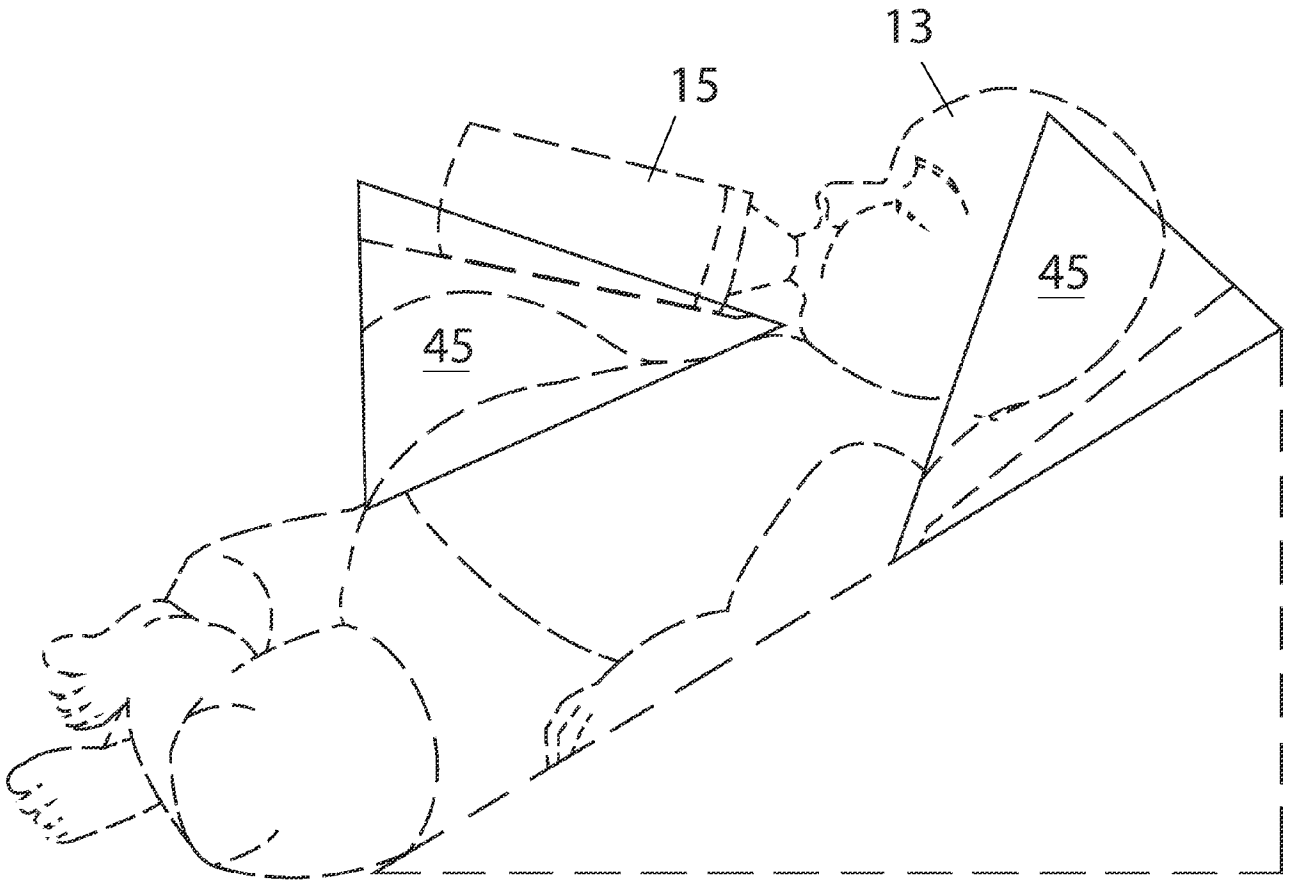
FIG. 10 is a side view showing a first embodiment of the reversible head-support and bottle-support baby pillow of the present invention with the baby in a sitting or reclining position.

The second longitudinal side 27 meets the first longitudinal side 35 at edge 39 and meets the third longitudinal side 25 at edge 29. The second longitudinal side 27 may meet the first longitudinal side 35 (at edge 39) or the third longitudinal side 25 (at edge 29) at a right angle, but preferably meets both the first longitudinal side 35 and third longitudinal side 25 at acute angles. Thus, though a cross-section of the wedge formed by the longitudinal sides 25, 27, 35 may be a right triangle, preferably it is an acute triangle. The particular angles at which the sides meet (the "vertices") are dictated by the application in which the reversible head-support and bottle-support baby pillow 10 will be utilized. For example, the baby pillow 10 may be used in a horizontal situation, such as a in a crib (as shown in FIG. 9), or may be used in a reclining setting, such as in a stroller or car seat (as shown in FIG. 10). Consequently, the lengths of the longitudinal sides 25, 27, 35 and the vertices employed when the baby pillow 10 will be utilized in a horizontal environment may vary compared to the lengths of the longitudinal sides 25, 27, 35 and the vertices employed when the baby pillow 10 will be utilized in a reclining setting. Thus a variety of lengths of the longitudinal sides 25, 27, 35 and a variety of vertices are within the scope of the invention.

Also within the scope of the invention is the placement of the head-receiving contour 30 within the first longitudinal side 35 compared to the placement of the bottle-receiving contour 20 within the third longitudinal side 25. This is shown in the views of the second longitudinal side 27 in the exemplary first, second, and third embodiments of FIG. 6, FIG. 7, and FIG. 8. In FIG. 6, the head-receiving contour 30 is substantially aligned with bottle-receiving contour 20. In FIG. 7, the head-receiving contour 30 is substantially centered with bottle-receiving contour 20 offset. In FIG. 8, both the head-receiving contour 30 and the bottle-receiving contour 20 are offset.

Additionally, the particular shapes of the head-receiving contour 30 and of the bottle-receiving contour 20 may vary while remaining within the scope of the invention. For example, the depths or widths of the depressions may vary somewhat, the angle of the neck support contour 33 with respect to the head rest contour 31 may vary, the angle of the bottle rest contour 21 with respect to the bottle stop contour 23 may vary, the angles at which the longitudinal sides 25, 27, 35 meet may vary, etc. Also, the particular dimensions of the two angular ends 40, 45 and of the three rectangular longitudinal sides 25, 27, 35 may be adjusted to meet specific applications and uses.

In the first three embodiments, the two angular ends 40, 45 are each shaped as a planar triangle. But in the fourth embodiment, as shown in FIG. 9, the contoured, pre-formed, wedge-shaped body of pillow 10 may be formed with each of the two angular ends 40, 45 shaped as a quadrilateral. The corners of the wedge at the sides of the head rest contour 31 may be truncated from point 49 to reduce the material required for manufacture and to reduce the pillow 10 size for convenience of storage and transport. In this embodiment the pillow 10 will rest on the baby up to the point 49 (FIG. 9), which is a sufficient area to serve as a wedge to support the bottle. The small bottle of the baby is supported by area 48, which rests directly on the chest of the baby. As a safety feature if the baby spits out the nipple the bottle 15 and the pillow 10 will fall. This will help prevent any negative consequences associated with the baby not being able to remove the bottle on its own.

To utilize the reversible head-support and bottle-support baby pillow 10 of the present invention, the parent chooses which side to face upward depending on the need. To provide head support for the baby, such as when sleeping (FIG. 9), feeding or traveling in a car seat (FIG. 10), the parent positions the baby pillow 10 with the first longitudinal side 35 upward and places the baby's head 13 within the head rest contour 31 and the baby's neck resting on the neck support contour 33. If instead, support is needed for a bottle, the parent positions the baby pillow 10 with the third longitudinal side 25 upward and places the bottle stop contour 23 toward the mouth. The bottle 15 is rested within the bottle rest contour 21 with the center of the nipple extending over the bottle stop contour 23 and with the exterior edge of the nipple area retained by the bottle stop contour 23.

Optionally, two reversible head-support and bottle-support baby pillows 10 may be used, as shown in FIG. 1, FIG. 9, and FIG. 10. Then the first pillow 10 may be turned with the first longitudinal side 35 upward and the second pillow 10 may be turned with the third longitudinal side 25 upward. The baby's head may be placed within the upward-facing head-receiving contour 30 of the first pillow 10. Then the second pillow 10 may be positioned over the trunk of the baby. The bottle is placed within the upward-facing bottle-receiving contour 20 with the nipple toward the baby's mouth. The baby's head 13 is elevated with the neck supported; this promotes spine alignment, increases comfort and encourages positive digestion.

The contoured, pre-formed, wedge-shaped body of pillow 10 is preferably a resilient solid (such as formed of a solid foam material or other foam material firm enough to provide support and to avoid any suffocation risk, yet soft enough to be comfortable), but may optionally be a pre-formed outer shell stuffed with a resilient material, or may be inflatable and formed of a pre-formed, contoured outer shell that is inflated upon use (such as formed of vinyl, PVC, polyurethane, or other lightweight and rugged inflatable material). A contoured generally tight-fitting removable cover (not shown) may optionally be provided to allow convenient washing. The cover may be tailored to fit the pillow's fairly complicated contours; it may be made out of any material which is pleasing when in contact with the skin and preferably absorbent or in some way able to carry off unwanted heat, for example, cotton or polypropylene. The closure may be any conventional closure device, such as a zipper, snaps, or complementary hook and loop fasteners. The closure should be positioned for comfort of the baby, such as on the second side 27 or on one of the two angular ends 40, 45.

From the foregoing, it will be apparent that the reversible head-support and bottle-support baby pillow 10 of the current invention provides a convenient, compact, pillow that reduces the incidence of flat head syndrome by providing a contoured head support, that is reversible to provide a bottle support, that can be used in pairs to provide both head support and bottle support, and that can promote good digestion by positioning the baby with the head elevated. The comfortable support of the head and neck encourages beneficial, sound sleeping. The contours of the head-receiving contour 30 gently cradle the baby's head, reducing pressure due to the large amount of surface area in contact with the baby's head, as compared to conventionally available head supports which provide no bottom support so the back of the head rests on a flat surface.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A pillow for a baby, comprising a contoured, pre-formed, wedge-shaped body comprising a first longitudinal side, a second longitudinal side, a third longitudinal side, and two opposing angular ends, wherein said first longitudinal side is configured with a head-receiving contour, wherein said third longitudinal side is configured with a bottle-receiving contour, and wherein said head-receiving contour comprises a neck support contour configured to receive the neck of said baby and a head rest contour configured to receive the head of said baby.

2. The pillow for a baby, as recited in claim 1, wherein said head rest contour is generally an arc-shaped depression joining said neck support contour.

3. A pillow for a baby, comprising a contoured, pre-formed, wedge-shaped body comprising a first longitudinal side, a second longitudinal side, a third longitudinal side, and two opposing angular ends, wherein said first longitudinal side is configured with a head-receiving contour, wherein said third longitudinal side is configured with a bottle-receiving contour, and wherein said bottle-receiving contour comprises a bottle stop contour and a bottle rest contour configured to receive a baby bottle.

4. The pillow for a baby, as recited in claim 3, wherein said bottle rest contour comprises a generally bottle-shaped channel ending in said bottle stop contour.

5. The pillow for a baby, as recited in claim 4, wherein:

said head-receiving contour comprises a neck support contour configured to receive the neck of said baby and a head rest contour configured to receive the head of said baby;

said head rest contour is generally an arc-shaped depression smoothly joining said neck support contour;

upon positioning said first longitudinal side upward, said neck and said head of said baby may be received by said pillow; and upon positioning said third longitudinal side upward, said bottle may be received by said bottle-receiving contour.

6. A pillow for a baby, comprising a contoured, pre-formed, wedge-shaped body comprising a first longitudinal side, a second longitudinal side, a third longitudinal side, and two opposing angular ends, wherein said first longitudinal side is configured with a head-receiving contour, wherein said third longitudinal side is configured with a bottle-receiving contour, and wherein said third longitudinal side meets said first longitudinal side at an acute angle.

7. The pillow for a baby, as recited in claim 6, wherein:

said second longitudinal side meets said first longitudinal side at an acute angle;

said second longitudinal side meets said third longitudinal side at an acute angle; and said wedge-shaped body is shaped as a triangular prism.

8. A pillow for a baby, comprising a contoured, pre-formed, wedge-shaped body comprising a first longitudinal side, a second longitudinal side, a third longitudinal side, and two opposing angular ends, wherein said first longitudinal side is configured with a head-receiving contour, wherein said third longitudinal side is configured with a bottle-receiving contour, and wherein said contoured, pre-formed, wedge-shaped body is inflatable and is formed of a flexible material pre-formed with said head-receiving contour and with said bottle-receiving contour.

9. The baby pillow, as recited in claim 8, wherein said flexible material is vinyl.

10. A method for feeding a baby from a baby bottle, comprising:

providing a first pre-formed, wedge-shaped pillow having a first longitudinal side configured with a first head-receiving contour, a second longitudinal side, a third longitudinal side configured with a first bottle-receiving contour having a first open end, and two first opposing angular ends;

positioning said first pre-formed wedge-shaped pillow on the chest of said baby with said first bottle-receiving contour upward and with said first open end toward the mouth of said baby; and positioning said baby bottle within said first bottle-receiving contour such that a nipple end of said baby bottle is positioned at said mouth of said baby for feeding.

11. The method for feeding a baby from a baby bottle, as recited in claim 10, further comprising:

removing said baby bottle from said first bottle-receiving contour;

removing said first pre-formed wedge-shaped pillow from said chest of said baby;

inverting said first pre-formed wedge-shaped pillow to position the first longitudinal side configured with a first head-receiving contour upward; and placing the head of said baby in said first head-receiving contour.

12. The method for feeding a baby from a baby bottle, as recited in claim 11, further comprising:

providing a second pre-formed, wedge-shaped pillow having a third longitudinal side configured with a second head-receiving contour, a fourth longitudinal side, a fifth longitudinal side configured with a second bottle-receiving contour having a second open end, and two second angular opposing ends;

positioning said second pre-formed wedge-shaped pillow on the chest of said baby with said second bottle-receiving contour upward and with said second open end toward said mouth of said baby; and positioning said baby bottle within said second bottle-receiving contour such that a nipple end of said baby bottle is positioned at said mouth of said baby for feeding.

13. The method for feeding a baby from a baby bottle, as recited in claim 10, wherein said wedge-shaped pillow comprises an inflatable pillow formed of a flexible, inflatable material pre-formed with said head-receiving contour and with said bottle-receiving contour.

14. The method for feeding a baby from a baby bottle, as recited in claim 10, wherein said wedge-shaped pillow is formed of a solid foam material.

* * * * *